US010024593B2

(12) United States Patent
Holm

(10) Patent No.: US 10,024,593 B2
(45) Date of Patent: Jul. 17, 2018

(54) UNDER COUNTER INSULATED ENCLOSURE

(71) Applicant: Adam Josha Holm, San Francisco, CA (US)

(72) Inventor: Adam Josha Holm, San Francisco, CA (US)

(73) Assignee: Adam Holm, San Francisco, CA (US)

( * ) Notice: Subject to any disclaimer, the term of this patent is extended or adjusted under 35 U.S.C. 154(b) by 0 days.

(21) Appl. No.: 14/999,954

(22) Filed: Jul. 20, 2016

(65) Prior Publication Data

US 2018/0023881 A1 Jan. 25, 2018

(51) Int. Cl.

| | |
|---|---|
| ***F25D 23/10*** | (2006.01) |
| ***F25B 21/02*** | (2006.01) |
| ***F25D 11/00*** | (2006.01) |
| ***F25D 25/02*** | (2006.01) |
| ***F25D 31/00*** | (2006.01) |
| ***F25D 23/02*** | (2006.01) |
| ***F25D 29/00*** | (2006.01) |

(52) U.S. Cl.

CPC ..... *F25D 23/10* (2013.01); *F25B 21/02* (2013.01); *F25D 11/00* (2013.01); *F25D 23/028* (2013.01); *F25D 25/024* (2013.01); *F25D 25/027* (2013.01); *F25D 29/005* (2013.01); *F25D 31/005* (2013.01)

(58) Field of Classification Search

CPC ..... F25D 23/10; F25D 29/005; F25D 23/028; F25D 31/005; F25D 25/027; F25D 11/00; F25D 25/024; F25B 21/02; A47B 88/44; A47B 88/447; A47B 88/43; A47B 88/45; A47B 88/48; A47B 88/60; A47B 88/80

See application file for complete search history.

(56) References Cited

U.S. PATENT DOCUMENTS

| | | | | |
|---|---|---|---|---|
| 4,358,171 | A * | 11/1982 | Christen | F25D 23/10 232/43.3 |
| 5,357,426 | A * | 10/1994 | Morita | A47F 10/00 700/90 |
| 7,628,461 | B2 * | 12/2009 | Carden | F25D 25/025 312/310 |
| 8,104,852 | B2 * | 1/2012 | Oh | F25D 25/025 312/310 |
| 8,160,741 | B1 * | 4/2012 | Shoenfeld | A47B 96/00 221/282 |
| 8,668,289 | B2 * | 3/2014 | Lee | E05B 17/0033 312/402 |
| 8,827,390 | B2 * | 9/2014 | Wehner | F25D 23/028 312/306 |
| 8,955,352 | B2 * | 2/2015 | Lee | F25D 23/02 312/273 |
| 9,243,840 | B1 * | 1/2016 | Kelly | F25D 25/025 |
| 9,462,884 | B2 * | 10/2016 | Hunter | A47B 67/04 |
| 2006/0181183 | A1 * | 8/2006 | Galloway | A47B 88/00 312/311 |

(Continued)

*Primary Examiner* — Michael C Zarroli

(57) ABSTRACT

An under counter insulated enclosure that is located partially under the corner portion of a standard kitchen counter. A Peltier cooling or heating assembly can cool or heat the enclosure. Sliding panels, that are actuated by motorized rack and pinion assemblies located near the floor of the enclosure allow the food storage racks sitting on top of the panels to slide and swivel so that the contents of both food racks are accessible to the user.

5 Claims, 5 Drawing Sheets

(56) References Cited

U.S. PATENT DOCUMENTS

| | | | | |
|---|---|---|---|---|
| 2010/0102689 | A1* | 4/2010 | Chambers | A47B 88/48 312/257.1 |
| 2011/0187250 | A1* | 8/2011 | Larson | A47B 3/0912 312/322 |

* cited by examiner

UNDER COUNTER INSULATED ENCLOSURE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of insulated containers and more specifically to an under the counter insulated enclosure that can be refrigerated or heated and that includes sliding racks that allow access to items that would normally be hidden the corner portion under a kitchen counter.

Kitchen counters usually have cabinets located under them for the storage of kitchen items such as cooking tools or food items that are in boxes or bottles. Traditionally, the corner portion of the cabinet area located under the corner of the counter is hard to access because the front doors of the cabinets do not allow the user to easily reach into the corner area.

To ease this problem cabinet designers have developed carrousel type devices that are located in the corner area so that the user can rotate the shelves of the carrousel to access stored items. Other cabinet designers have developed V shaped doors that help open up the corner area, however it is still difficult to access contents that are located deep in the corner of the under counter area.

Additionally, in recent times, cabinet manufacturers have incorporated refrigerated enclosures that are located under the counter.

Although improvements have been made in accessing items under the corner of a kitchen counter, no one has addressed the issue of storing items in a refrigerated, or heated enclosure that is also located in the corner area under a kitchen counter.

BRIEF SUMMARY OF THE INVENTION

The primary object of the invention is to provide an under the counter insulated enclosure that can be heated or cooled via a Peltier assembly.

Another object of the invention is to provide an under the counter enclosure that includes two sliding panels that allow the user to have access to items that are stored under the corner space of a typical kitchen counter.

Another object of the invention is to provide an under the counter enclosure that allows access to items stored on food storage racks sitting on top of the sliding panels.

A further object of the invention is to provide an under the counter enclosure that uses motorized rack and pinion assemblies so that the sliding and pivoting action needed to provide access to both racks is automatic.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an under counter insulated enclosure comprising: an insulated enclosure, an enclosure door, a Peltier cooling or heating assembly, a first sliding platform, a second sliding platform, a first motorized rack and pinion assembly, a second motorized rack and pinion assembly, a motorized pivot assembly, a first food storage rack and a second food storage rack, said enclosure door hinged to said insulated enclosure forming a fully insulated enclosure, said first sliding platform capable of sliding left or right via said first rack and pinion assembly, said second sliding platform capable of sliding forward or backward via said second rack and pinion assembly, said first and second food storage racks sitting on said first and second sliding panels and said second food storage rack capable of rotating one hundred and eighty degrees via said motorized pivot assembly to have complete access to both food storage racks.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now to FIGS. 1, 2, 3 and 4 we see a top plan view of the invention in progressive stages of operation.

Figure 1:
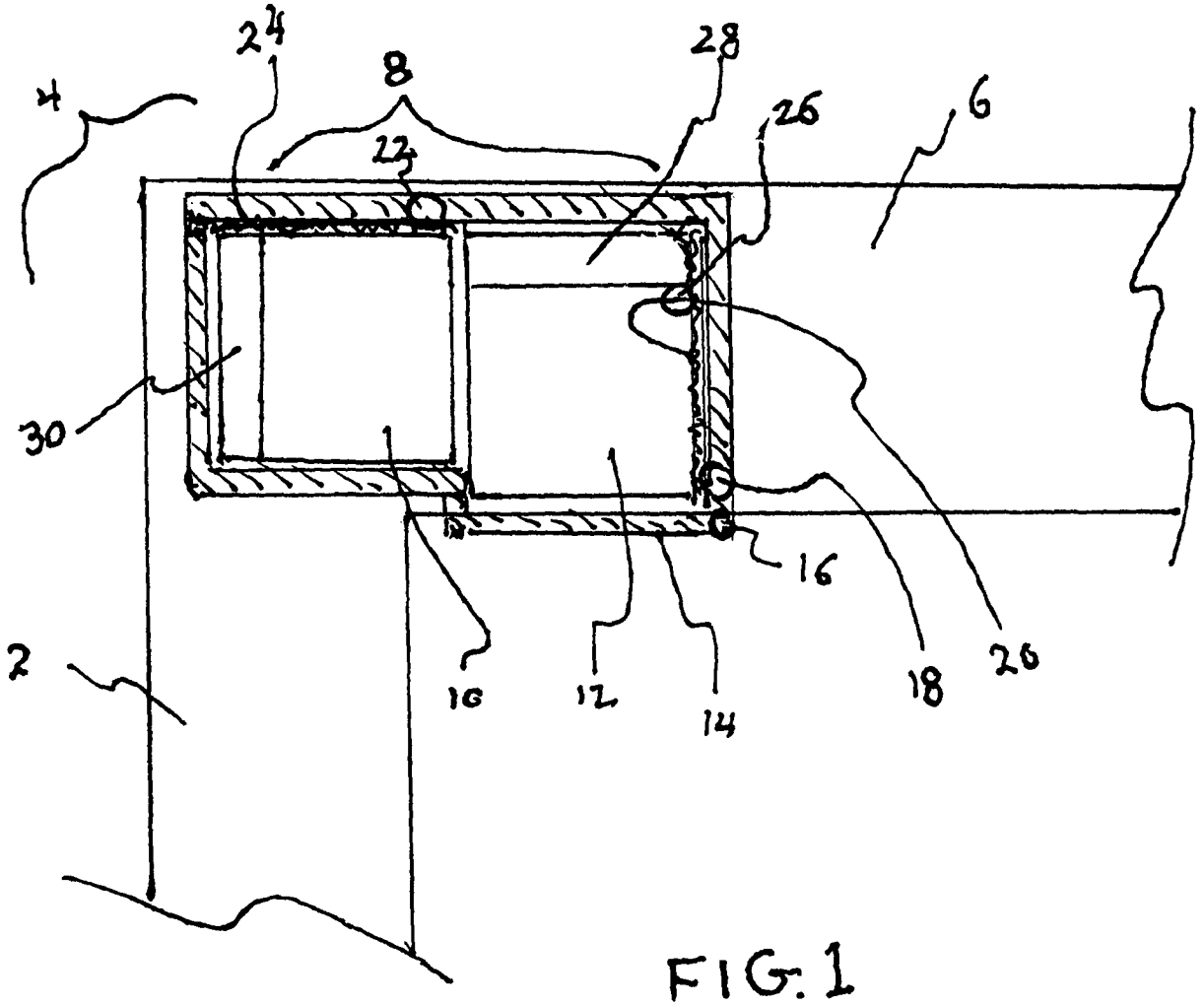
FIG. 1 is a top plan view of the invention in the closed position

FIG. 1 shows the invention in its closed position. The counter top is removed to show the enclosure 8 within. The first sliding platform 30 sits at the floor of the enclosure 8, under the corner 4 of the counter 2, 6 and can slide to the left and back to the right via rack 24 and motorized pinion 22. A first food storage rack assembly 10 sits on top of sliding panel 30 and can hold food items such as wine bottles or other foods. The second sliding panel 28 is located adjacent to the first panel 30. A rack 20 and motorized pinion gear 18 can cause the second sliding panel 28 and associated stacked food storage rack 12 to slide out of the under counter space. Insulated enclosure door 14 pivots on hinge pivot 16.

Figure 2:
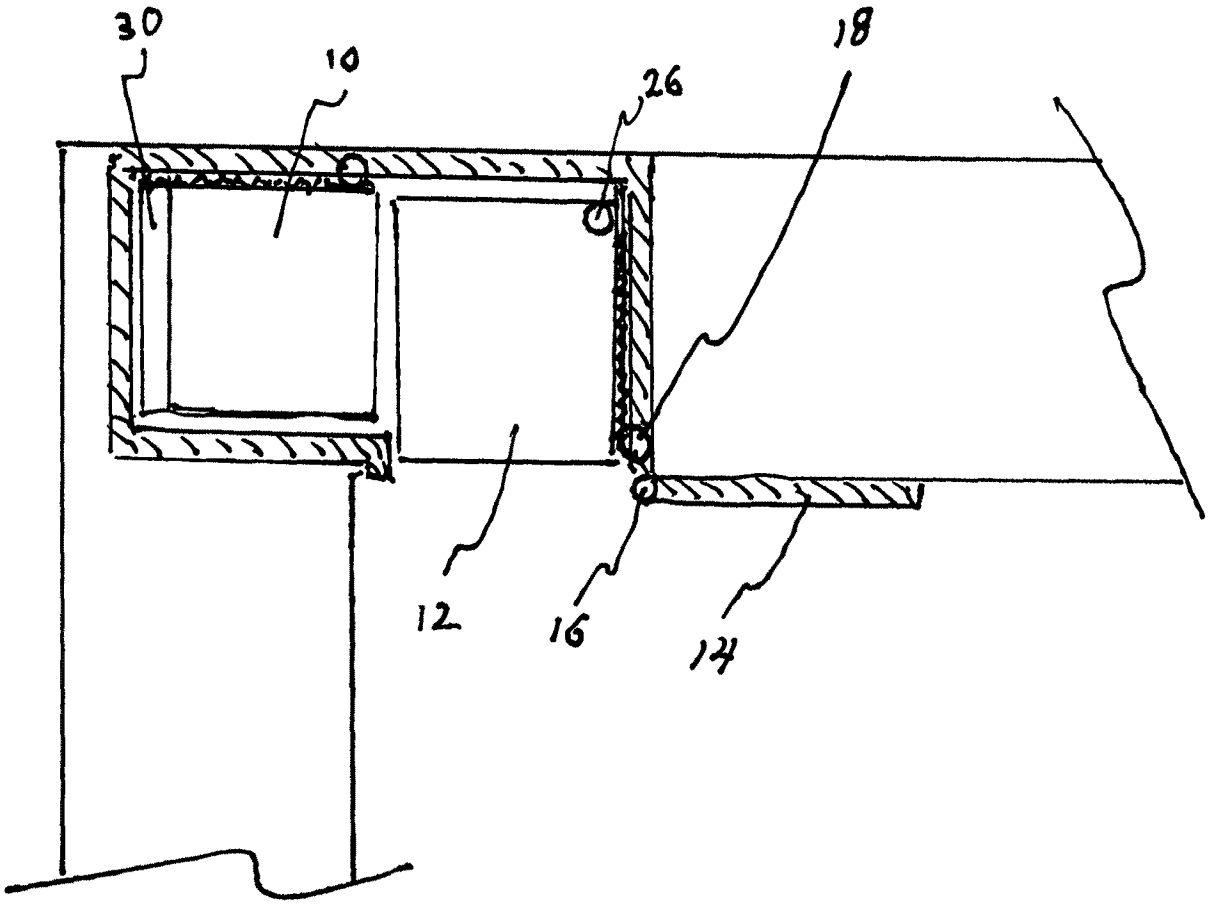
FIG. 2 is a top plan view of the invention with the enclosure door opened.

FIG. 2 shows insulated enclosure door 14 swung open one hundred and eighty degrees thereby exposing second food storage rack 12.

Figure 3:
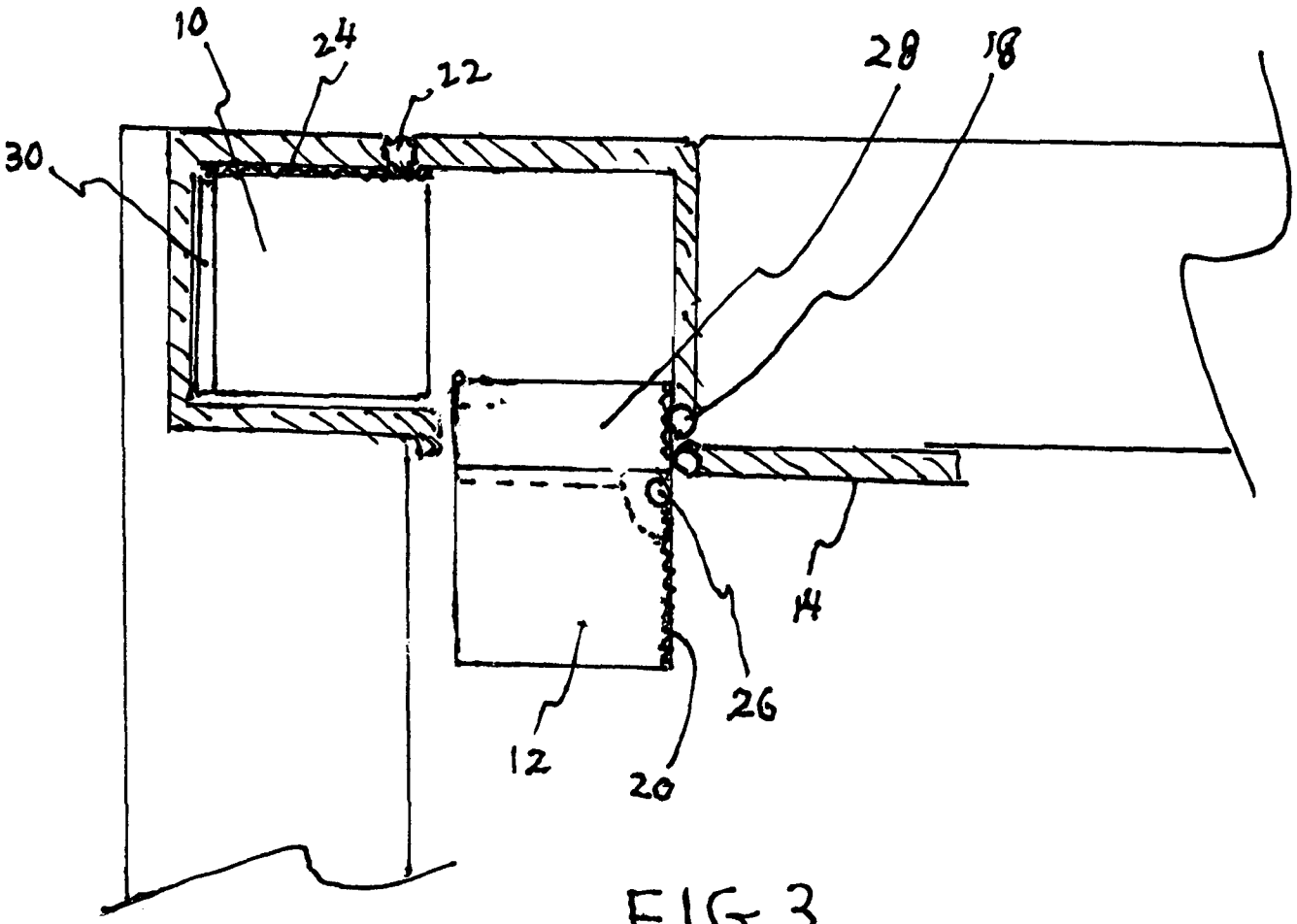
FIG. 3 is a top plan view of the invention with the first panel slid out.

FIG. 3 shows second sliding panel 28 and associated food storage rack assembly 12 slid out from under the counter via rack 20 and pinion gear 18.

Figure 4:
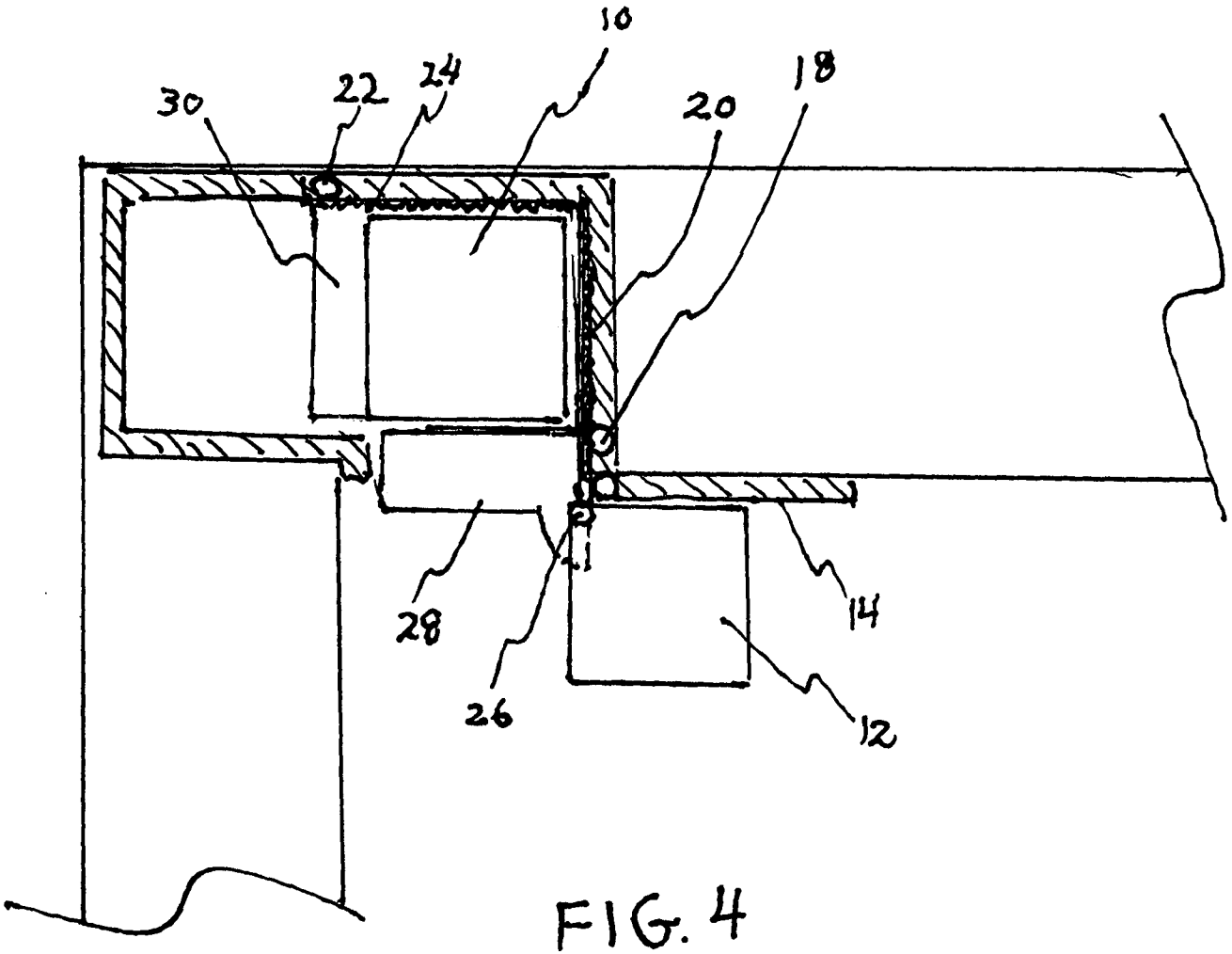
FIG. 4 is a top plan view of the invention with the first panel slid out and the first rack pivoted one hundred and eighty degrees and the second panel and associated rack slid to the right.

FIG. 4 shows the first sliding panel 30 slid to the right and the second food storage rack assembly 12 pivoted one hundred and eighty degrees via pivot motor 26. This configuration exposes the previously hidden first rack assembly 10 as well as second rack assembly 12 allowing the user easy access to both rack assemblies 10, 12. The enclosure can be either cooled or heated by a Peltier assembly mounted at the bottom of the enclosure. The nature of a Peltier assembly is that depending on the polarity of the electrical connection, the assembly can produce a cooling effect or a heating effect. Therefore, the racks 10, 12 can hold trays of heated food, or can hold a variety of cooled items such as wine bottles or other food items needing refrigeration.

Figure 5:
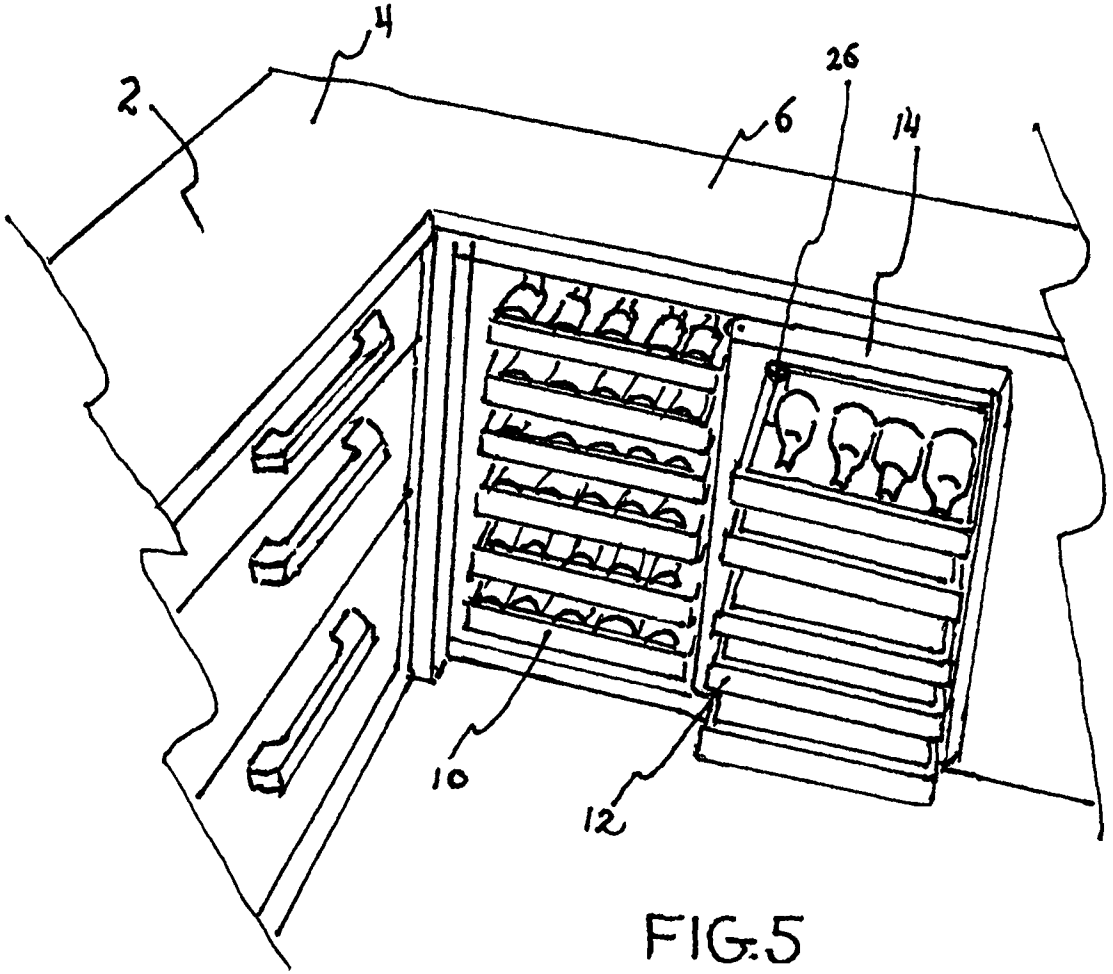
FIG. 5 is a perspective view of the invention in the fully open position.

FIG. 5 is a perspective view of the invention in the fully open position as shown in FIG. 4. Insulated enclosure door 14 is swung fully open. In this case both food storage rack 10 and food storage rack 12 are holding a plurality of wine bottles that are now fully accessible to the user. Food storage rack 10 has been moved from the stored position located in the corner 4 of counter top 2, 6 to the accessible location that previously held food storage rack 12.

One optional feature includes the addition of an insulated panel positioned between the first rack 10 and the second rack 12 so that items on each rack 10, 12 can be kept at different temperatures.

In a second embodiment of the invention, the food storage racks 10,12 can be removed and replaced with a plurality of removable beer kegs.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Under counter insulated enclosure comprising:
an insulated enclosure;
an enclosure door;
a Peltier cooling or heating assembly;
a first sliding platform;
a second sliding platform;
a first motorized rack and pinion assembly;
a second motorized rack and pinion assembly;
a first food storage rack
a second food storage rack
a motorized pivot assembly;
said enclosure door hinged to said insulated enclosure forming a fully insulated enclosure;
said first sliding platform capable of sliding left of to right via said first rack and pinion assembly;
said second sliding platform capable of sliding forward or backward via said second rack and pinion assembly;
said first food storage rack sitting on said first sliding platform;
said second food storage rack sitting on said second sliding platform;
and said second food storage rack capable of rotating one hundred and eighty degrees via said motorized pivot assembly.

2. An under counter insulated enclosure as claimed in claim 1 wherein said racks are horizontally disposed and can hold food items or bottles.

3. An under counter insulated enclosure as claimed in claim 1 wherein items stored on said racks can be either cooled or heated by said Peltier assembly.

4. An under counter insulated enclosure as claimed in claim 1 said stored items of both racks can be accessed when said racks are in their fully deployed position.

5. An under counter insulated enclosure as claimed in claim 1 wherein said first food storage rack and said second food storage rack are exchanged for a plurality of beer holding kegs.

* * * * *